US009911259B1

(12) United States Patent
Ghabra et al.

(10) Patent No.: US 9,911,259 B1
(45) Date of Patent: Mar. 6, 2018

(54) PASSIVE ENTRY PASSIVE START (PEPS) SYSTEM WITH INTEGRATED AUTHORIZATION AND RANGING COMMUNICATIONS

(71) Applicant: Lear Corporation, Southfield, MI (US)

(72) Inventors: Riad Ghabra, Northville, MI (US); Robert Mariani, Troy, MI (US); Keith A. Christenson, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/411,675

(22) Filed: Jan. 20, 2017

(51) Int. Cl.
*G07C 9/00* (2006.01)

(52) U.S. Cl.
CPC ..... *G07C 9/00111* (2013.01); *G07C 2209/63* (2013.01)

(58) Field of Classification Search
CPC ..... G07C 9/00111; G07C 2209/63
USPC ..... 340/5.61–5.64
See application file for complete search history.

(56) References Cited

U.S. PATENT DOCUMENTS 5,723,911 A 3/1998 Glehr
8,930,045 B2 1/2015 Oman et al.
9,566,945 B2 * 2/2017 Ghabra ..... B60R 25/24
9,763,097 B2 * 9/2017 Robinson ..... H04W 12/08
9,792,613 B2 * 10/2017 Gong ..... G06Q 30/018
2010/0007462 A1 1/2010 Biondo et al.
2014/0022051 A1 * 1/2014 Levien ..... G05D 1/0011 340/5.2
2015/0291127 A1 * 10/2015 Ghabra ..... G07C 9/00309 701/2
2015/0296348 A1 10/2015 Ghabra
2016/0332598 A1 * 11/2016 Ghabra ..... B60R 25/24
2016/0337863 A1 * 11/2016 Robinson ..... H04W 12/08
2017/0069214 A1 * 3/2017 Dupray ..... G08G 5/0021

FOREIGN PATENT DOCUMENTS

WO 2005114593 A1 12/2005

* cited by examiner

*Primary Examiner* — Allen T Cao
(74) *Attorney, Agent, or Firm* — Brooks Kushman P.C.

(57) ABSTRACT

A system includes a remote controller, such as a fob, and a base station at a target device, such as a vehicle. The remote controller and the base station are configured to communicate authorization communications and time-of-flight (ToF) communications between one another over a common communications channel. The base station is further configured to confirm from the authorization communications whether the remote controller is authorized for controlling a function of the target device and to confirm from the ToF communications whether the remote controller is within a predetermined range of the target device. The base station is further configured to prevent the function from being controlled by the control unit when the control unit is not within the predetermined range of the target device.

20 Claims, 4 Drawing Sheets

PASSIVE ENTRY PASSIVE START (PEPS) SYSTEM WITH INTEGRATED AUTHORIZATION AND RANGING COMMUNICATIONS

TECHNICAL FIELD

The present invention relates to passive entry and/or passive start (PEPS) systems.

BACKGROUND

Passive entry and/or passive start (PEPS) systems include a portable remote controller and a base station. The remote controller, for instance, a key fob ("fob"), is carried by a user. The base station is at a target device such as a vehicle. The fob and the base station wirelessly communicate with one another for remote control of the target device.

Passive entry functions provided by a vehicular PEPS system include automatically unlocking vehicle doors when an authorized fob is brought into the vicinity of the vehicle. The PEPS system may detect for an authorized fob in response to a vehicle door handle being touched. Passive start functions provided by a vehicular PEPS system include automatically starting the vehicle upon a user in possession of the authorized fob pressing a start button near the driver's seat.

A "relay attack" is a process for deceiving a vehicular PEPS system. A relay attack is typically carried out by two thieves while the vehicle user is remotely located away from the vehicle. Each thief has a transceiver. A first thief stands next to the vehicle. The second thief stands near the vehicle user, whom is carrying an authorized fob. The relay attack begins with the first thief actuating the door handle or pressing the start button. The base station of the PEPS system responds by transmitting a short range communication pursuant to the ordinary authorization process. Unlike the first thief transceiver, the fob is too far away to receive the communication. The first thief transceiver relays the communication to the second thief transceiver. The second thief transceiver retransmits the communication to the fob. The fob responds by replying with authorization information. The second thief transceiver relays the authorization information to the base station. In turn, the base station causes the door to be unlocked or the vehicle to be started. A relay attack thus includes relaying short range PEPS communication over a relatively long distance without permission of the vehicle user.

SUMMARY

A method includes communicating authorization communications and time-of-flight (ToF) communications over a common communications channel between a remote controller and a base station at a target device to confirm from the authorization communications whether the remote controller is authorized for controlling a function of the target device and to confirm from the ToF communications whether the remote controller is within a predetermined range of the target device. The method further includes preventing the function to be controlled when the remote controller is not within the predetermined range of the target device.

The method may further include communicating a trigger signal from the base station to the remote controller and initiating by the remote controller upon receiving the trigger signal from the base station the step of communicating authorization communications and ToF communications over the common communications channel between the remote controller and the base station.

The method may further include communicating wakeup communications between the remote controller and the base station to wake the remote controller and to acknowledge to the base station that the remote controller is awake. In this case, the step of communicating the trigger signal from the base station occurs after the wakeup communications in response to the base station being acknowledged that the remote controller is awake. Further, in this case, the method may include communicating the wakeup communications between the remote controller and the base station commences upon user interaction with the target device being detected.

The authorization communications and the ToF communications may be communicated over the common communications channel between the remote controller and the base station using ultra-wide-band (UWB) communications. In this case, the common communications channel is a UWB communications channel.

The trigger signal may be communicated from the base station to the remote controller using either low-frequency (LF) communications or UWB communications.

The wakeup communications may be communicated between the remote controller and the base station using LF communications and ultra-high frequency (UHF) communications.

The authorization communications may include a challenge message of the base station and a response message of the remote controller. The ToF communications may include a ranging request message of the base station and a ranging reply message of the remote controller. The step of communicating authorization communications and ToF communications includes communicating the challenge message and the ranging request over the common communications channel from the base station to the remote controller and communicating the response message and the ranging reply message over the common communications channel from the remote controller to the base station. At least one of (i) a signal having the challenge message and the ranging request message may be communicated over the common communications channel from the base station to the remote controller and (ii) a signal having the response message and the ranging reply message may be communicated over the common communications channel from the remote controller to the base station.

The method may further include enabling the function of the target device to be controlled when the remote controller is within the predetermined range of the target device and the remote controller is authorized to control the function of the target device.

A system includes a remote controller and a base station at a target device. The remote controller and the base station are configured to communicate authorization communications and time-of-flight (ToF) communications between one another over a common communications channel. The base station is further configured to confirm from the authorization communications whether the remote controller is authorized for controlling a function of the target device and to confirm from the ToF communications whether the remote controller is within a predetermined range of the target device. The base station is further configured to prevent the function from being controlled by the remote controller when the remote controller is not within the predetermined range of the target device.

DETAILED DESCRIPTION

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
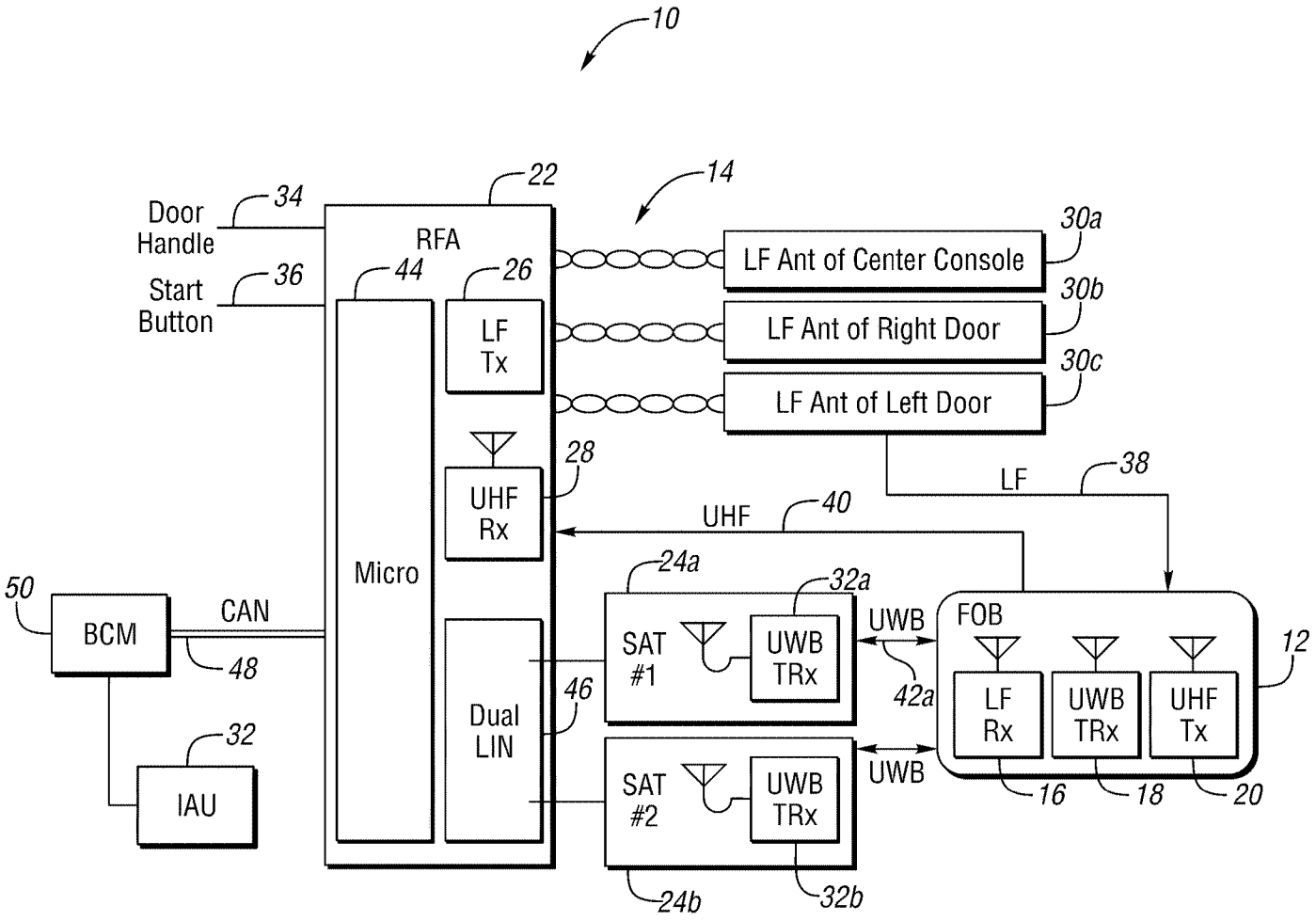
FIG. 1 illustrates a block diagram of a remote control system having a portable remote controller and a base station.
Figure 2:
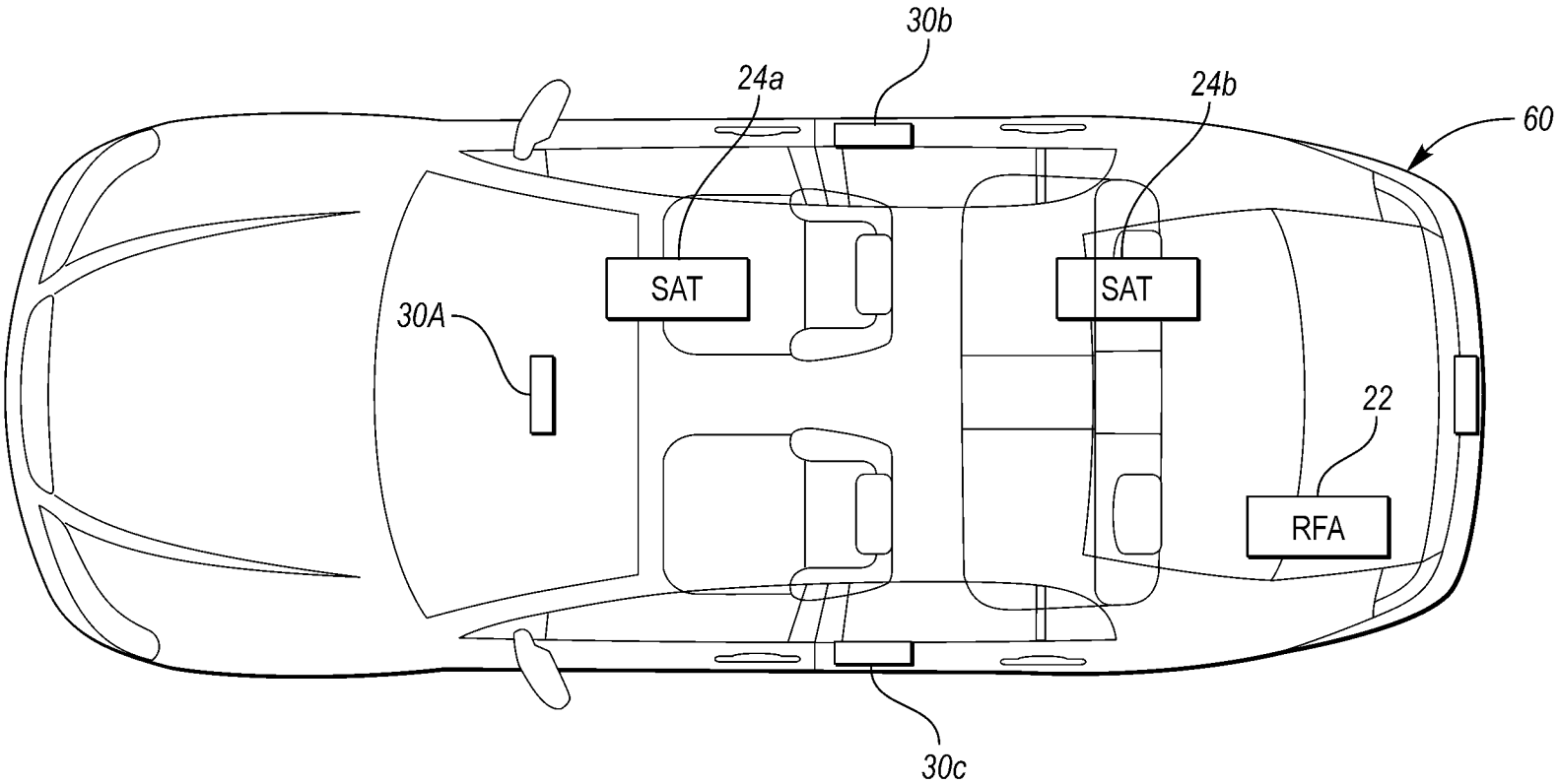
FIG. 2 illustrates a schematic diagram of a vehicle having the base station.

Referring now to FIG. 1, a block diagram of a remote control system 10 is shown. Remote control system 10 includes a portable remote controller 12 and a base station 14. Base station 14 is at a target device. The target device is assumed to be a vehicle 60 such as shown in FIG. 2. In other embodiments, the target device is a house, a garage, a gate, a building, a door, a lighting system, or the like. Base station 14 is configured to be able to control functions of vehicle 60. Remote controller 12 and base station 14 are operable for wirelessly transmitting/receiving communications to/from one another to enable the remote controller to remotely control vehicle 60 via the base station.

Remote control system 10 is configured to perform passive entry and/or passive start (PEPS) functions. PEPS capability enables remote controller 12 to remotely control vehicle 60 automatically (or "passively") without user actuation of the remote controller. As an example of a passive entry function, base station 14 unlocks a door of vehicle 60 in response to the presence of remote controller 12 being brought into the vicinity of the vehicle being detected. Base station 14 can detect the presence of remote controller 12 being brought into the vicinity of vehicle 60 when a user carrying the remote controller touches a door handle of the vehicle. As an example of a passive start function, base station 14 starts vehicle 60 upon a user in possession of remote controller 12 pressing a start button on the vehicle dashboard.

Remote control system 10 may be further configured to perform remote keyless entry (RKE) functions. RKE capability enables remote controller 12 to remotely control vehicle 60 in response to user actuation of buttons or the like of the remote controller. As an example of a RKE function, base station 14 unlocks a door of vehicle 60 in response to receiving a vehicle door unlock command from remote controller 12. Remote controller 12 transmits the vehicle door unlock command to base station 14 in response to corresponding user actuation of the remote controller.

Remote controller 12 is a portable device to be carried by a user. Remote controller 12 is assumed to be a key fob ("fob"). In other embodiments, remote controller 12 is a smart phone, a tablet, a wearable device such as a smart watch, or the like.

In general, in regards to PEPS capability, fob 12 and base station 14 engage in a series of (i) wakeup communications and (ii) integrated authorization and ranging (i.e., time-of-flight ("ToF")) communications. The integrated authorization and ToF communications take place following the wakeup communications. The integrated authorization and ToF communications include authorization communications and ToF communications.

The authorization communications and the ToF communications are integrated with one another in that the authorization communications and the ToF communications occur as part of the same communications over the same communications channel (frequency or operation or center frequency). For instance, the authorization and ToF communications take place concurrently using the same communications format and the same transmitter/receiver components of fob 12 and the same transmitter/receiver components of base station 14. For example, in one embodiment, as part of the integrated authorization and ToF communications, a communication signal from base station 14 includes a message (e.g., challenge from the base station) of the authorization communications and a message (e.g., Range ACK from the base station) of the ToF communications and a communication signal from fob 12 includes a message (e.g., response from the fob to the challenge) of the authorization communications and a message (e.g. Range Receive from the fob) of the ToF communications.

The wakeup communications between fob 12 and base station 14 involve "waking up" the fob. The wakeup communications commence upon detecting a user action such as touching a door handle of vehicle 60 or pressing the vehicle start button. The wakeup communications may also commence when fob 12 comes near vehicle 60 upon a user with the fob walking towards the vehicle. Base station 14 commences the wakeup communications upon detecting the user touching or "touchless" interaction with vehicle 60.

The authorization communications between fob 12 and base station 14 are intended to verify that the fob is authorized (i.e., authenticated) for remotely controlling vehicle 60. The authorization communications involve authorizing the enablement of a vehicle function (e.g., unlocking a vehicle door or starting the vehicle) corresponding to the detected user action.

The ToF communications between fob 12 and base station 14 are for confirming that the fob is within the vicinity (i.e., within a predetermined range) of vehicle 60. The ToF communications are used to prevent a relay attack. The ToF communications involve measuring time duration for a signal to travel between fob 12 and base station 14. The rate of time at which the signal travels is known. As such, the time for the signal to travel between fob 12 and base station 14 is a function of the distance between the fob and the base station. Therefore, if the time for the signal to travel between fob 12 and base station 14 is too long, then the fob cannot be within vicinity of vehicle 60. In this case, the enablement of the vehicle function is prevented even when the authorization communications authorize the enablement of the vehicle function. The enablement of the vehicle function is prevented because the authorization communications authorizing the enablement of the vehicle function are the subject of a relay attack.

The fact that the authorization communications are being subjected to a relay attack is discerned from detecting the time duration (i.e., the ToF) between fob 12 and base station 14 being too long. For instance, as described above in the Background section, during a relay attack an excessive time delay occurs as a result of the extended round trip time by way of the transceivers used by the two thieves.

Thus, base station 14 does not perform the corresponding vehicle function (e.g., unlocking the vehicle door, starting the engine) whenever the ToF communications indicate that fob 12 is not within the vicinity of the vehicle. On the other hand, base station 14 performs the corresponding vehicle function when (i) the authorization communications verify that fob 12 is authorized for remotely controlling vehicle 60 and (ii) the ToF communications verify that the fob is within the vicinity of the vehicle.

The authorization communications and the ToF communications between fob 12 and base station 14 take place concurrently as these communications are integrated with one another. It is envisioned that the ToF determination will conclude faster than the authorization determination. As such, the ToF process does not add any additional delay.

As shown in FIG. 1, fob 12 includes a low-frequency (LF) receiver 16, an ultra-wide band (UWB) transceiver (transmitter/receiver) 18, and an ultra-high frequency (UHF) transmitter 20. LF receiver 16, UWB transceiver 18, and UHF transmitter 20 have their own antennas as indicated in FIG. 1. LF receiver 16 is operable for receiving LF signals from base station 14. UWB transceiver 18 is operable for transmitting/receiving UWB signals to/from base station 14. UHF transmitter 20 is operable for transmitting UHF signals to base station 14.

As examples, the LF operating frequency range is between 20 to 300 kHz; the UWB operating frequency range is between 3 to 10 GHz including a 3.5 to 6.5 GHz operating range of interest; and the UHF operating frequency range is between 300 MHz to 3 GHz including a 300 MHz to 1 GHz operating range of interest.

As further shown in FIG. 1, base station 14 includes a remote function actuator (RFA) ("controller") 22, a first satellite 24*a*, and a second satellite 24*b*. Base station 14 may include further satellites or may have just one satellite. Controller 22 and satellites 24*a* and 24*b* are located at vehicle 60 as shown in FIG. 2. Satellites 24*a* and 24*b* are positioned at respective locations of vehicle 60 (e.g., the forward vehicle side and the rearward vehicle side).

Controller 22 includes a LF transmitter 26 and a UHF receiver 28. LF transmitter 26 is associated with one or more antennas such as antennas 30*a*, 30*b*, and 30*c*. Antennas 30*a*, 30*b*, and 30*c* are positioned at respective locations of vehicle 60 (e.g., center console, right vehicle door, left vehicle door) as shown in FIG. 2. LF transmitter 26 is operable for transmitting LF signals via antennas 30*a*, 30*b*, and 30*c* to fob 12. UHF receiver 28 has its own antenna and is operable for receiving UHF signals from fob 12. Satellites 24*a* and 24*b* include respective UWB transceivers 32*a* and 32*b*. UWB transceivers 32*a* and 32*b* are operable for transmitting/receiving UWB signals to/from fob 12.

The wakeup communications between fob 12 and base station 14 take place using LF transmitter 26 of controller 22, LF receiver 16 of the fob, UHF transmitter 20 of the fob, and UHF receiver 28 of the controller. The integrated authorization and ToF communications between fob 12 and base station 14 take place using UWB transceiver 18 of the fob and UWB transceiver 32*a* of first satellite 24*a*. (UWB transceiver 32*b* of second satellite 24*b* in conjunction with UWB transceiver 18 of fob 12 is also used for the integrated authorization and ToF communications, but its description will be omitted for simplicity.)

The wakeup communications and the integrated authorization and ToF communications between the receivers, transmitters, and transceivers of fob 12, controller 22, and first satellite 24*a* will now be described in greater detail. Controller 22 initiates the wakeup communication process in response to detecting a user action such as touching a door handle or pressing the vehicle start button. In this regard, controller 22 includes a door handle detection input 34 and a vehicle start button detection input 36. Alternatively, controller 22 initiates the wakeup communication process in response to detecting fob 12 being moved near vehicle 60. Upon the user action being detected, LF transmitter 26 of controller 22 transmits a LF wakeup signal along LF communications link 38 for receipt by fob 12. Fob 12 wakes up in response to LF receiver 16 of the fob receiving the LF wakeup signal. In turn, UHF transmitter 20 of fob 12 transmits an acknowledgement signal along UHF communications link 40 for receipt by controller 22.

The acknowledgment signal from fob 12 includes identifying information indicative of the fob. The acknowledgment signal from fob 12 may further include an indication of the strength of the LF wakeup signal as received by the fob (i.e., a received signal strength indicator (RSSI)).

Upon controller 22 of base station 14 processing the acknowledgment signal from fob 12 (for instance, analyzing the identifying information in the acknowledgment signal to confirm that the fob is a fob that is pre-programmed to the base station), the controller transmits a LF trigger signal along LF communications link 38 for receipt by fob 12. The trigger signal includes a command to fob 12 requesting that the fob initiate the integrated authorization and ToF communications between the fob and base station 14.

Fob 12 commences the integrated authorization and ToF communications by having UWB transceiver 18 of the fob initially transmit a UWB communications signal along UWB communications link 42*a* for receipt by first satellite 24*a*. The integrated authorization and ToF communications continue with UWB transceiver 32*a* of first satellite 24*a* and UWB transceiver 18 of fob 12 communicating UWB communications with one another along UWB communications link 42*a*.

The authorization communications of the integrated authorization and ToF communications include first satellite 24*a* transmitting a UWB communications signal including an encrypted challenge message for receipt by fob 12. Fob 12 generates a response message for responding to the challenge message in response to receiving the challenge message. The authorization communications further include fob 12 transmitting a UWB communications signal including an encrypted response message for receipt by first satellite 24*a*. Controller 22 analyzes the response message from fob 12 to determine whether the response message satisfies the challenge message. If the response message satisfies the challenge message, then controller 22 determines fob 12 to be authorized for remotely controlling vehicle 60. Controller 22 authorizes enablement of a vehicle function (e.g., unlocking a vehicle door or starting the vehicle) corresponding to the detected user action upon determining that fob 12 is authorized.

The ToF communications of the integrated authorization and ToF communications include fob 12 transmitting a UWB communications signal having a ping message for receipt by first satellite 24*a*. Fob 12 may transmit this UWB communications signal having the ping message multiple times during the integrated authorization and ToF communications. A first one of these UWB communications signals having the ping message from fob 12 commences the integrated authorization and ToF communications. As such, fob 12 transmits the first UWB communications signal having the ping message in response to receiving the trigger signal from base station 14.

First satellite 24*a* in response to receiving the ping message from fob 12 transmits a UWB communications signal including a ranging request message (e.g., Range ACK) for receipt by the fob. Fob 12 in response to receiving the ranging request message from first satellite 24*a* transmits a UWB communications signal including a ranging reply (e.g., Range Data) for receipt by first satellite 24*a*.

After first satellite 24*a* receives the ranging reply message, controller 22 measures the time duration from transmission of the ranging request by first satellite 24*a* to receipt of the ranging reply message by the first satellite. If the time duration is longer than a predetermined time duration corresponding to a predetermined distance, then controller 22 determines that fob 12 is not within the vicinity of vehicle 60 (or, more accurately, not within the vicinity of first satellite 24*a*). Controller 22 prevents the enablement of the vehicle function while fob 12 is determined to not be within the vicinity of vehicle 60 regardless of the authorization decision by the controller.

The same integrated authorization and ToF communications between fob 12 and first satellite 24*a* may be performed between the fob and second satellite 24*b*. This may be desired to be done as fob 12 may be closer to the location of second satellite 24*b* than to the location of first satellite 24*a*.

As shown in FIG. 1, controller 22 further includes a microcontroller 44 and a dual local interconnect network (LIN) 46. Microcontroller 44 monitors door handle detection input 34 and vehicle start button detection input 36 to detect user actuation of a door handle or the vehicle start button. Microcontroller 44 handles the wakeup and integrated authorization and ToF communication processes of base station 14. Microcontroller 44 controls the transmitting and receiving operations of LF transmitter 26 and UHF receiver 28, respectively, in handling the associated wakeup communications. Microcontroller 44 communicates via dual LIN 46 with UWB transceivers 32*a* and 32*b* of satellites 24*a* and 24*b* in regards to the integrated authorization and ToF communications.

Controller 22 may be in communication via a vehicle network such as a CAN bus 48 with other vehicle controllers such as a body control module (BCM) 50. Through CAN bus 48 and BCM 50, controller 22 may communicate with an immobilizer antenna unit (IAU) 52. IAU 52 provides LF/LF immobilizer functions to fob 12 for backup starting (i.e., when the battery power of the fob is insufficient).

Figure 3A:
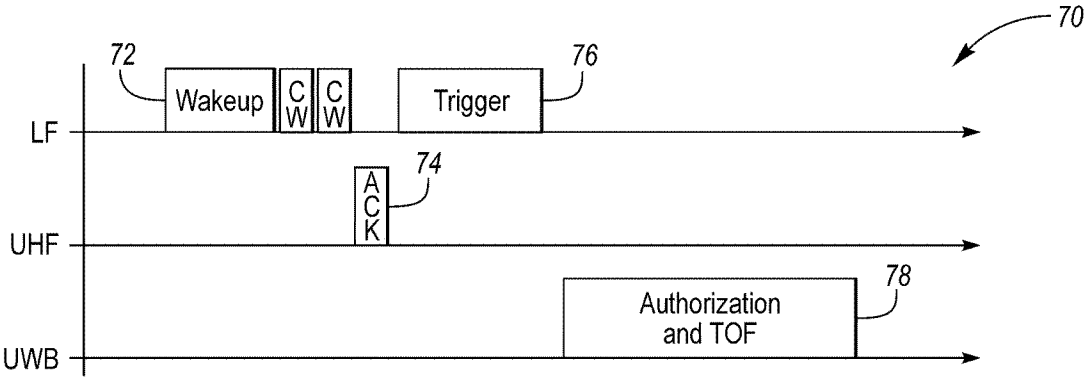
FIG. 3A illustrates a timing diagram of the communications of the remote control system with the assumed condition that only one remote controller which is pre-programmed to the base station is in the presence of the base station, the communications including (i) wakeup communications between the remote controller and the base station and (ii) integrated authorization and ranging (i.e., time-of-flight ("ToF")) communications between the remote controller and the base station.

Referring now to FIG. 3A, with continual reference to FIG. 1, a timing diagram 70 of the wakeup communications and the integrated authorization and ToF communications between fob 12 and base station 14 is shown. For simplicity, timing diagram 70 is based on the assumption that only a single fob 12 which is pre-programmed (i.e., paired) to base station 14 is in the presence of the base station.

The wakeup communication process initiates, for instance, by door handle detection input 34 generating a detection pulse in response to a user touching a door handle of vehicle 60. In response to the door handle being touched, LF transmitter 26 of controller 22 transmits a wakeup signal 72 for receipt by fob 12. After fob 12 wakes up upon receiving wakeup signal 72, UHF transmitter 20 of the fob transmits an acknowledgement signal 74 for receipt by base station 14. Acknowledgement signal 74 acknowledges from fob 12 to base station 14 that the fob is awake.

After base station 14 receives acknowledgement signal 74 from fob 12, LF transmitter 26 of controller 22 transmits a trigger signal 76 for receipt by the fob. Trigger signal 76 includes a command to fob 12 requesting that the fob initiate the integrated authorization and ToF communications between the fob and base station 14. The integrated authorization and ToF communications between fob 12 and base station 14 involve the fob and the base station (more particularly, the fob and each of first and second satellites 24*a* and 24*b*) communicating UWB authorization and ToF communications signals 78 between one another.

Figure 4:
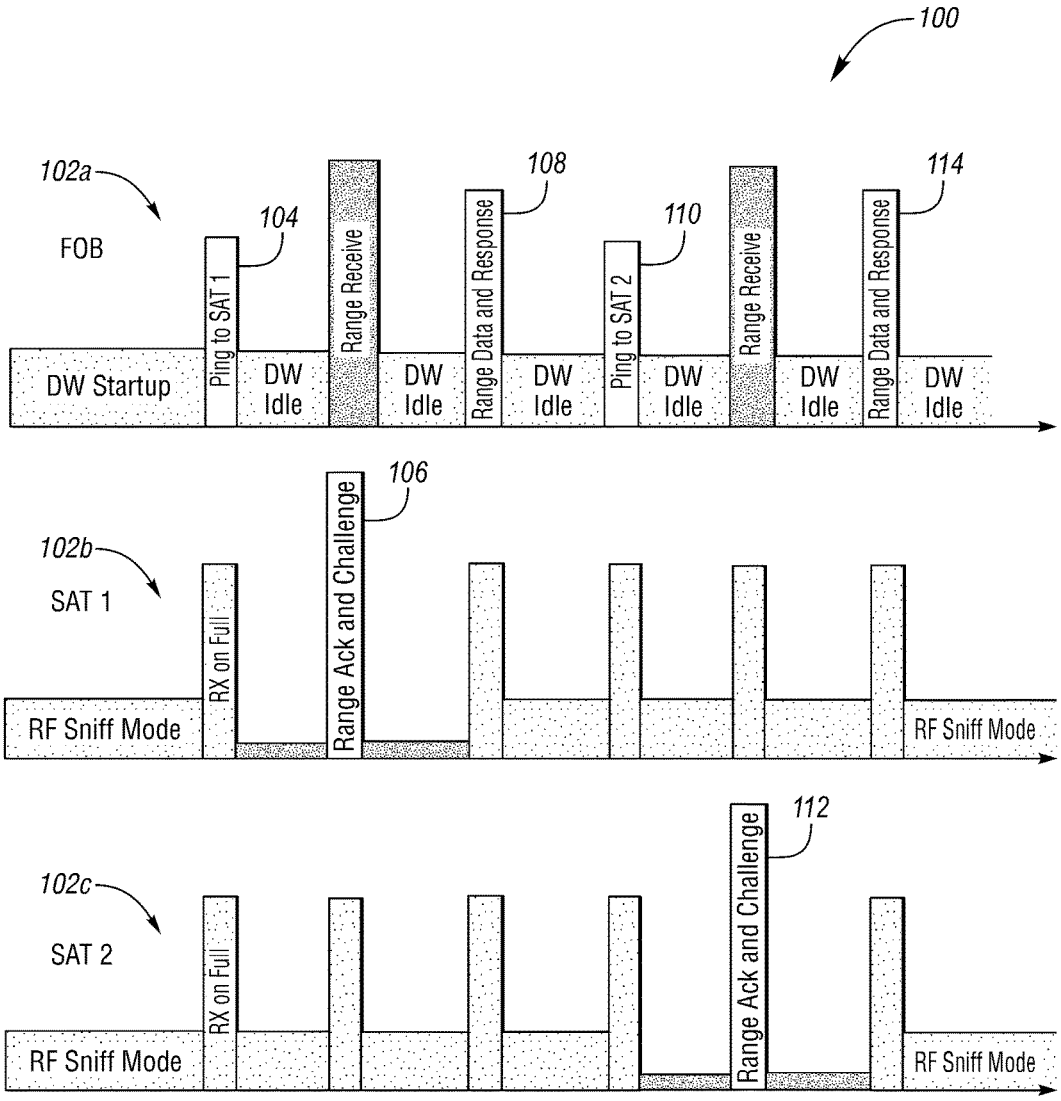
FIG. 4 illustrates a timing diagram of an exemplary version of the integrated authorization and ranging communications between a remote controller and the base station.

Referring now to FIG. 4, with continual reference to FIGS. 1 and 3A, a timing diagram 100 of an exemplary version of the integrated authorization and ToF communications between fob 12 and first and second satellites 24*a* and 24*b* of base station 14 is shown. Timing diagram 100 includes a timing diagram portion 102*a* indicative of the integrated authorization and ToF communications signaling of fob 12, a timing diagram portion 102*b* indicative of the integrated authorization and ToF communications signaling of first satellite 24*a*, and a timing diagram portion 102*c* indicative of the integrated authorization and ToF communications signaling of second satellite 24*b*.

As shown in timing diagram 100 of FIG. 4, fob 12 commences the integrated authorization and ToF communications by transmitting a UWB communications signal 104 including a ping message for receipt by first satellite 24*a*. First satellite 24*a* in response to receiving the ping message from fob 12 transmits at a designated time a UWB communications signal 106 including a ranging request message (e.g., Range ACK) for receipt by the fob. The ranging request message is part of the ToF communications. In this exemplary version, UWB communications signal 106 further includes a challenge message of base station 14. The challenge message is part of the authorization communications. Fob 12 in response to receiving the ranging request message from first satellite 24*a* transmits a UWB communications signal 108 including a ranging reply message (e.g., Range Data) for receipt by first satellite 24*a*. The ranging reply message is part of the authorization communications. Fob 12 in response to receiving the challenge message of base station 14 generates a response message responsive to the challenge message. In this exemplary version, UWB communications signal 108 further includes the response message from fob 12.

Controller 22 determines fob 12 to be authorized for remotely controlling vehicle 60 when the response message satisfies the challenge message. Controller 22 measures the time duration from transmission of the ranging request message by first satellite 24*a* to receipt of the ranging reply message by the first satellite. If the time duration is longer than a predetermined time duration corresponding to a predetermined distance, then controller 22 determines that fob 12 is not within the vicinity of first satellite 24*a*. Controller 22 prevents the enablement of the vehicle function while fob 12 is determined to not be within the vicinity of vehicle 60 regardless of the authorization decision by the controller.

As shown in timing diagram 100 of FIG. 4, the same integrated authorization and ToF communications between fob 12 and first satellite 24*a* may be performed between the fob and second satellite 24*b*. As shown, fob 12 commences the integrated authorization and ToF communications with second satellite 24*b* by transmitting a UWB communications signal 110 including a ping message for receipt by second satellite 24*b*. Second satellite 24*b* in response to receiving the ping message from fob 12 transmits at a designated time a UWB communications signal 112 including a ranging request message and a challenge message for receipt by the fob. In response, fob 12 transmits a UWB communications signal 114 including a ranging reply message and a response message for receipt by second satellite 24*b*.

Controller 22 determines from the response message whether fob 12 is authorized for remotely controlling vehicle 60. Controller 22 determines from the time duration from transmission of the ranging request message by second satellite 24*b* to receipt of the ranging reply message by the second satellite whether fob 12 is within the vicinity of the second satellite. As described, controller 22 prevents the enablement of the vehicle function while fob 12 is determined to not be within the vicinity of vehicle 60 regardless of the authorization decision by the controller.

Figure 3B:
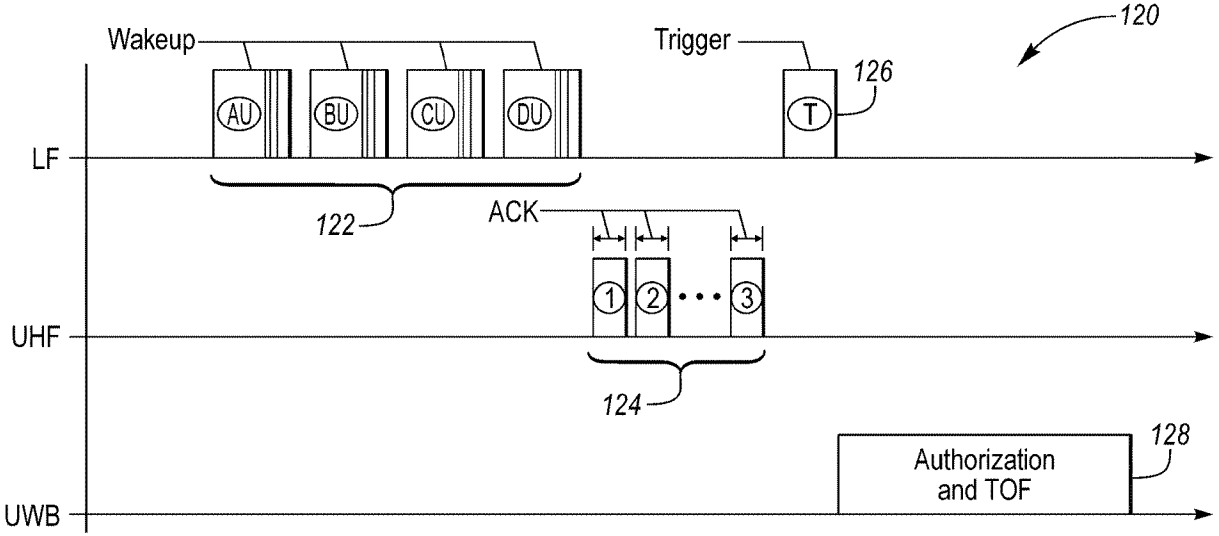
FIG. 3B illustrates a timing diagram of the communications of the remote control system with the assumed condition that multiple remote controllers which are pre-programmed to the base station are in the presence of the base station, the communications including (i) wakeup communications between the remote controllers and the base station and (ii) integrated authorization and ranging communications between a selected one of the remote controllers and the base station.

Referring now back to FIG. 3B, with continual reference to FIGS. 1 and 3A, a timing diagram 120 of the wakeup communications and the integrated authorization and ToF communications between fob 12 and base station 14 is shown. Timing diagram 120 is based on the assumption that multiple fobs including fob 12 which are pre-programmed to base station 14 are in the presence of the base station. In timing diagram 120 the wakeup communications are between the fobs and base station 14 and the integrated authorization and ToF communications are between a selected one of the fobs (i.e., fob 12) and the base station.

Base station 14 initiates the wakeup communication process by LF transmitter 26 of controller 22 transmitting a plurality of wakeup signals 122 for receipt by the fobs. For instance, wakeup signals 122 are respectively transmitted by different ones of LF antennas 30*a*, 30*b*, and 30*c* of base station 14. Each of the fobs wakes up in response to receiving at least one of the wakeup signals 122. UHF transmitter 20 of the fobs transmit, at designated times respectively associated with the fobs, acknowledgement signals 124 for receipt by base station 14. In an alternative implementation, UWB transceiver 18 of the fobs transmit, at the designated times respectively associated with the fobs, acknowledgment signals 124 for receipt by base station 14. Acknowledgment signals 124 from the fobs are transmitted at the designated times as base station 14 would otherwise be jammed and unable to successfully receive the acknowledgment signals.

Acknowledgement signals 124 from the fobs acknowledge to base station 14 that the fobs are awake. Acknowledgment signals 124 from the fobs include identifying information indicative of the fobs. For instance, acknowledgement signal 124 from a first fob includes identifying information which identifies the first fob as being the first fob whereas acknowledgment signal 124 from a second fob includes identifying information which identifies the second fob as being the second fob. Acknowledgement signals 124 from the fobs further include information indicative of the received strength of the wakeup signals (i.e., a received signal strength indicator (RSSI)). For instance, acknowledgement signal 124 from the first fob further includes a RSSI of a wakeup signal 122 as received by the first fob whereas acknowledgement signal 124 from the second fob further includes a RSSI of a wakeup signal 122 as received by the second fob. The RSSI of a wakeup signal received by a fob may be obtained by measuring the received strength of continuous wave (CW) signals transmitted as part of the wakeup signal.

Base station 14 analyzes acknowledgment signals 124 received from the fobs to select from the fobs the fob (i.e., fob 12) that corresponds to a user interaction with the vehicle. For instance, base station 14 selects fob 12 when the user interaction is actuation of the driver side door handle and fob 12 is closest of all of the fobs to the driver side vehicle door. Similarly, base station 14 selects fob 12 when the user interaction is actuation of the start button near the driver's seat and fob 12 is the only fob located within the vehicle. As such, in selecting the fob that corresponds to the user interaction with the vehicle, base station 14 initially confirms from the received fob identifying information that the fobs are fobs which are pre-programmed with base station 14. Base station 14 then determines from the pre-programmed fobs the fob (i.e., fob 12) that corresponds to the user interaction with the vehicle. Base station 14 uses the RSSI information from the fobs in making this determination.

Upon selecting fob 12, base station 14 transmits a trigger signal 126 via LF transmitter 26 of controller 22 for receipt by fob 12. Trigger signal 126 includes information identifying the trigger signal as being for receipt by fob 12 as opposed to being for receipt by any of the other fobs. Trigger signal 126 further includes a command to fob 12. The command requests that fob 12 initiate the integrated authorization and ToF communications between fob 12 and base station 14. The integrated authorization and ToF communications involve fob 12 and base station 14 communicating UWB authorization and ToF communications signals 128 between one another as described herein.

The exchanges of UWB authorization and ToF communications signals 78 and 128 consist of a certain predetermined amount of communication attempts. Fob 12 communicates UWB authorization and ToF communications signals 78 and 128 with first and second satellites 24*a* and 24*b* with multiple retries for each satellite. Remote control system 10 only requires one successful exchange between fob 12 and one satellite 24*a* or 24*b* in order for the function requested to be performed. The validity of the UWB exchange includes correct data and valid distance of fob 12 to vehicle 60. The UWB exchanges are halted upon a successful exchange whereby at least one of satellite units 24*a* and 24*b* informs fob 12 to halt any subsequent planned communication exchange retries in order to preserve battery life of the fob.

Further, under certain conditions, UWB transceivers of fob 12 and satellite units 24*a* and 24*b* may erroneously communicate while not being configured to be on the same channel. To avoid a mismatch in UWB channels (frequency of operation or center frequency) between fob 12 and satellite units 24*a* and 24*b*, the UWB challenge message and the UWB response message each contains a code which corresponds to the particular center frequency.

Further, remote control system 10 is configured to employ the integrated authorization and ToF communications only for PEPS applications which are candidates for a relay attack. As described, passive entry and passive start are such applications. Other passive applications such as passive lock and search key are not candidates for a relay attack. Accordingly, remote control system 10 does not employ ToF communications for such passive applications. This will conserve battery life of fob 12.

As described, in regards to PEPS capability, fob 12 and base station 14 engage in a series of (i) wakeup communications and (ii) integrated authorization and ToF communications. The wakeup communications have been described as using LF and UHF. The authorization communications and the ToF communications have been described as using UWB. UWB is an example of communications which can provide ranging (i.e., ToF) capability. Other communication protocols which may be substituted in place of UWB for the integrated authorization and ToF communications include wide-band (WB), Doppler, and UHF.

While exemplary embodiments are described above, it is not intended that these embodiments describe all possible invention forms. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method comprising:

communicating authorization communications and time-of-flight (ToF) communications over a common communications channel between a remote controller and a base station at a target device to confirm from the authorization communications whether the remote controller is authorized for controlling a function of the target device and to confirm from the ToF communications whether the remote controller is within a predetermined range of the target device; and preventing the function to be controlled when the remote controller is not within the predetermined range of the target device.

2. The method of claim 1 further comprising:

communicating a trigger signal from the base station to the remote controller; and initiating by the remote controller upon receiving the trigger signal from the base station the step of communicating authorization communications and ToF communications over the common communications channel between the remote controller and the base station.

3. The method of claim 2 further comprising:

communicating wakeup communications between the remote controller and the base station to wake the remote controller and to acknowledge to the base station that the remote controller is awake; and wherein the step of communicating the trigger signal from the base station occurs after the wakeup communications in response to the base station being acknowledged that the remote controller is awake.

4. The method of claim 3 further comprising:

detecting user interaction with the target device; and wherein communicating the wakeup communications between the remote controller and the base station commences upon the user interaction being detected.

5. The method of claim 2 wherein:

communicating authorization communications and ToF communications over the common communications channel between the remote controller and the base station is conducted using ultra-wide-band (UWB) communications; and communicating the trigger signal from the base station to the remote controller is conducted using either low-frequency (LF) communications or UWB communications.

6. The method of claim 3 wherein:

communicating authorization communications and ToF communications over the common communications channel between the remote controller and the base station is conducted using ultra-wide-band (UWB) communications;

communicating the trigger signal from the base station to the remote controller is conducted using either low-frequency (LF) communications or UWB communications; and communicating wakeup communications between the remote controller and the base station is conducted using LF communications and ultra-high frequency (UHF) communications.

7. The method of claim 1 wherein:

the authorization communications include a challenge message of the base station and a response message of the remote controller;

the ToF communications include a ranging request message of the base station and a ranging reply message of the remote controller; and the step of communicating authorization communications and ToF communications includes communicating the challenge message and the ranging request message over the common communications channel from the base station to the remote controller and communicating the response message and the ranging reply message over the common communications channel from the remote controller to the base station.

8. The method of claim 1 wherein:

the authorization communications include a challenge message of the base station and a response message of the remote controller;

the ToF communications include a ranging request message of the base station and a ranging reply message of the remote controller; and the step of communicating authorization communications and ToF communications includes communicating at least one of (i) a signal having the challenge message and the ranging request message over the common communications channel from the base station to the remote controller and (ii) a signal having the response message and the ranging reply message over the common communications channel from the remote controller to the base station.

9. The method of claim 1 further comprising:

enabling the function of the target device to be controlled when the remote controller is within the predetermined range of the target device and the remote controller is authorized to control the function of the target device.

10. A method comprising:

communicating authorization communications and time-of-flight (ToF) communications over a common communications channel between a remote controller and a base station at a target device to confirm from the authorization communications whether the remote controller is authorized for controlling a function of the target device and to confirm from the ToF communications whether the remote controller is within a predetermined range of the target device;

preventing the function to be controlled when the remote controller is not within the predetermined range of the target device; and wherein communicating authorization communications and ToF communications over the common communications channel between the remote controller and the base station is conducted using ultra-wide-band (UWB) communications.

11. A system comprising:

a remote controller;

a base station at a target device;

wherein the remote controller and the base station are configured to communicate authorization communications and time-of-flight (ToF) communications between one another over a common communications channel;

wherein the base station is further configured to confirm from the authorization communications whether the remote controller is authorized for controlling a function of the target device and to confirm from the ToF communications whether the remote controller is within a predetermined range of the target device; and wherein the base station is further configured to prevent the function from being controlled by the remote controller when the remote controller is not within the predetermined range of the target device.

12. The system of claim 11 wherein:

the base station is further configured to communicate a trigger signal to the remote controller; and the remote controller is further configured to initiate communication of the authorization communications and the ToF communications between the remote controller and the base station upon receiving the trigger signal from the base station.

13. The system of claim 12 wherein:

the remote controller and the base station are further configured to communicate wakeup communications between one another to wake the remote controller and to acknowledge to the base station that the remote controller is awake; and the base station is further configured to communicate the trigger signal to the remote controller after the wakeup communications in response to the base station being acknowledged that the remote controller is awake.

14. The system of claim 13 wherein:

the base station is further configured to detect user interaction with the target device; and the remote controller and the base station are further configured to communicate the wakeup communications between one another upon the user interaction being detected.

15. The system of claim 14 wherein:

the target device is a vehicle, the user interaction includes one of a door handle of the vehicle being touched and a start button of the vehicle being touched, and the function of the vehicle to be controlled corresponds to the user interaction.

16. The system of claim 11 wherein:

the remote controller and the base station are further configured to communicate the authorization communications and the ToF communications over the common communications channel between one another using ultra-wide-band (UWB) communications.

17. The system of claim 12 wherein:

the remote controller and the base station are further configured to communicate the authorization communications and the ToF communications over the common communications channel between one another using ultra-wide-band (UWB) communications; and the base station is further configured to communicate the trigger signal to the remote controller using either low-frequency (LF) communications or UWB communications.

18. The system of claim 13 wherein:

the remote controller and the base station are further configured to communicate the authorization communications and the ToF communications over the common communications channel between one another using ultra-wide-band (UWB) communications;

the base station is further configured to communicate the trigger signal to the remote controller using either low-frequency (LF) communications or UWB communications; and the remote controller and the base station are further configured to communicate the wakeup communications between one another using LF communications and ultra-high frequency (UHF) communications.

19. The system of claim 11 wherein:

the authorization communications include a challenge message of the base station and a response message of the remote controller;

the ToF communications include a ranging request message of the base station and a ranging reply message of the remote controller; and the remote controller and the base station to communicate the authorization communications and the ToF communications over the common communications channel between one another are further configured to communicate the challenge message and the ranging request message over the common communications channel from the base station to the remote controller and communicate the response message and the ranging reply message over the common communications channel from the remote controller to the base station.

20. The system of claim 11 wherein:

the authorization communications include a challenge message of the base station and a response message of the remote controller;

the ToF communications include a ranging request message of the base station and a ranging reply message of the remote controller; and the remote controller and the base station to communicate the authorization communications and the ToF communications over the common communications channel between one another are further configured to communicate at least one of (i) a signal having the challenge message and the ranging request message over the common communications channel from the base station to the remote controller and (ii) a signal having the response message and the ranging reply message over the common communications channel from the remote controller to the base station.

* * * * *